US008104313B2

(12) United States Patent
Wolfe

(10) Patent No.: US 8,104,313 B2
(45) Date of Patent: Jan. 31, 2012

(54) SECURITY ENCLOSURE FOR A GUN

(75) Inventor: James E. Wolfe, Watauga, TX (US)

(73) Assignee: Wolfe's Den, LLC, Watauga, TX (US)

( * ) Notice: Subject to any disclaimer, the term of this patent is extended or adjusted under 35 U.S.C. 154(b) by 959 days.

(21) Appl. No.: 11/945,841

(22) Filed: Nov. 27, 2007

(65) Prior Publication Data

US 2010/0212372 A1 Aug. 26, 2010

(51) Int. Cl.
*B65D 55/14* (2006.01)

(52) U.S. Cl. ..... 70/63; 206/317; 42/70.11; 109/47

(58) Field of Classification Search ..... 70/63, 57.1, 70/58; 109/47, 48, 53, 54, 58; 224/249; 42/1.01, 70.01, 70.06, 70.07, 70.09, 70.11; 340/5.7, 5.73, 5.8, 5.81, 5.82, 5.83; 206/317
See application file for complete search history.

(56) References Cited

U.S. PATENT DOCUMENTS

| | | | | |
|---|---|---|---|---|
| 4,309,065 | A | 1/1982 | Pappas | |
| 4,768,021 | A * | 8/1988 | Ferraro | 70/63 |
| 4,800,822 | A | 1/1989 | Adkins | |
| 5,111,755 | A | 5/1992 | Rouse | |
| 5,118,175 | A * | 6/1992 | Costello | 206/317 |
| 5,671,830 | A * | 9/1997 | Wood | 224/587 |
| 5,701,770 | A * | 12/1997 | Cook et al. | 70/63 |
| 5,779,114 | A | 7/1998 | Owens | |
| 5,987,941 | A * | 11/1999 | Zocco | 70/63 |
| D426,059 | S | 6/2000 | Siler et al. | |
| 6,260,300 | B1 | 7/2001 | Klebes et al. | |
| 6,363,760 | B1 | 4/2002 | Sigmond | |
| 6,405,861 | B1 | 6/2002 | Siler et al. | |
| 6,488,148 | B1 * | 12/2002 | Woodson | 70/63 |
| 6,563,940 | B2 | 5/2003 | Recce | |
| 6,570,501 | B2 | 5/2003 | Bushnell et al. | |
| 6,678,984 | B1 | 1/2004 | Rapp et al. | |
| 6,829,917 | B2 * | 12/2004 | Russell | 70/63 |
| 6,843,081 | B1 | 1/2005 | Painter | |
| 6,868,975 | B2 | 3/2005 | Sells et al. | |
| 6,918,519 | B2 | 7/2005 | Vor Keller et al. | |
| 7,043,946 | B2 | 5/2006 | Cline | |
| 7,096,801 | B2 | 8/2006 | Bartel et al. | |
| 7,143,913 | B2 | 12/2006 | Lindsey et al. | |
| 7,178,370 | B2 | 2/2007 | Engel | |
| 7,210,665 | B2 | 5/2007 | Suzuki | |
| 7,299,667 | B1 | 11/2007 | Miresmaili | |

(Continued)

OTHER PUBLICATIONS

United States Patent Office, "Notification of Transmittal of the International Search Report and The Written Opinion of the International Searching Authority, or the Declaration," for PCT/US2008/084323, mailed Feb. 13, 2009, 11 pages.

(Continued)

*Primary Examiner* — Suzanne Barrett
*Assistant Examiner* — Christopher Boswell
(74) *Attorney, Agent, or Firm* — Haynes and Boone, LLP

(57) ABSTRACT

A security enclosure for a handgun includes an enclosure base having an opening to an interior portion and a cover configured to selectively cover the opening in the enclosure base. The cover may be configured in a manner to rotate from a first position in which the cover blocks access to the interior portion of the enclosure base to a second position in which the cover allows access to the interior portion of the enclosure base. A gun enclosure may be rotatably disposed within the enclosure base. A biometric recognition device may be configured to operatively unlock the cover when exposed to a required feature of an authorized user.

27 Claims, 5 Drawing Sheets

OTHER PUBLICATIONS

Information from Web page for GilbertsGuns, http://www.gilbertsguns.com/Gun+Vaults/Titan/Titan+Gun+Vault?SID=3874cc3a91dd28a2eeebc0648ce, printed on Mar. 14, 2008, pp. 1-5.

Promotional ad for Titan Gun Vault, http://www.titangunvault.com/gun-safe/titan-gun-vault, printed Dec. 20, 2010, 4 pages.

* cited by examiner

SECURITY ENCLOSURE FOR A GUN

BACKGROUND OF THE INVENTION

The present disclosure relates to a firearm storage apparatus, and more particularly to a security enclosure apparatus for handguns which can be quickly opened for withdrawal of the gun.

While the need for a handgun in an emergency situation requires that it be easily accessible, it is also well recognized that means must be provided to limit access to those for whom its use is not intended. There are different methods of securing handguns against unauthorized use, but they all have some disadvantages associated with them. If the gun is secured in a locked cabinet, it is not readily available for use in self-defense. In comparison, a locking mechanism that allows the gun to be readily available for use, such as a trigger lock, may often be misplaced after being removed and lost due to its small size.

The present invention is directed to overcoming one or more of the limitations of the existing security enclosure apparatus for handguns.

SUMMARY

The present disclosure is directed to a security enclosure comprising an enclosure base having an opening to an interior portion and a cover configured to selectively cover the opening in the enclosure base. The cover may be configured in a manner to rotate from a first position in which the cover blocks access to the interior portion of the enclosure base to a second position in which the cover allows access to the interior portion of the enclosure base. A gun enclosure may be rotatably disposed within the enclosure base. A biometric recognition device may be configured to operatively unlock the cover when exposed to a required feature of an authorized user.

In another exemplary aspect, the present disclosure is directed to a security enclosure comprising an enclosure base having an opening to an interior portion and a cover configured to selectively cover the opening in the enclosure base. The cover may be configured in a manner to rotate from a first position in which the cover blocks access to the interior portion of the enclosure base to a second position in which the cover allows access to the interior portion of the enclosure base. A gun enclosure may be rotatably disposed within the enclosure base. The gun enclosure may be arranged to secure a handgun such that grip of the handgun is adjacent the cover.

In another exemplary aspect, the present disclosure is directed to a security enclosure comprising an enclosure base having an opening to an interior portion and a cover configured to selectively cover the opening in the enclosure base. The cover may be configured in a manner to rotate from a first position in which the cover blocks access to the interior portion of the enclosure base to a second position in which the cover allows access to the interior portion of the enclosure base. A biometric recognition device may be configured to operatively unlock the cover from the enclosure base when exposed to required feature of an authorized user. A gun enclosure may be configured to rotate about a pivot point within the enclosure base.

In yet another exemplary aspect, the present disclosure is directed to a security enclosure for a handgun. The security enclosure may include an enclosure base having an opening to an interior portion and a cover configured to selectively cover the opening in the enclosure base. The cover may be configured in a manner to rotate from a first position in which the cover blocks access to the interior portion of the enclosure base to a second position in which the cover allows access to the interior portion of the enclosure base. A biometric fingerprint recognition device may be configured to operatively unlock the cover from the enclosure base when exposed to a required feature of an authorized user. The security enclosure also may comprise a gun enclosure shaped to receive a handgun. The gun enclosure may be configured to rotate about a pivot point within the enclosure base to rotatably displace a handgun from a position within the enclosure base to a position where at least a part of the handgun protrudes out of the opening. A rotation mechanism may be disposed within the enclosure base and may be operatively associated with the gun enclosure. The rotation mechanism being configured to exert a force that rotates the gun enclosure about the pivot point.

DETAILED DESCRIPTION OF THE DRAWINGS

Figure 1:
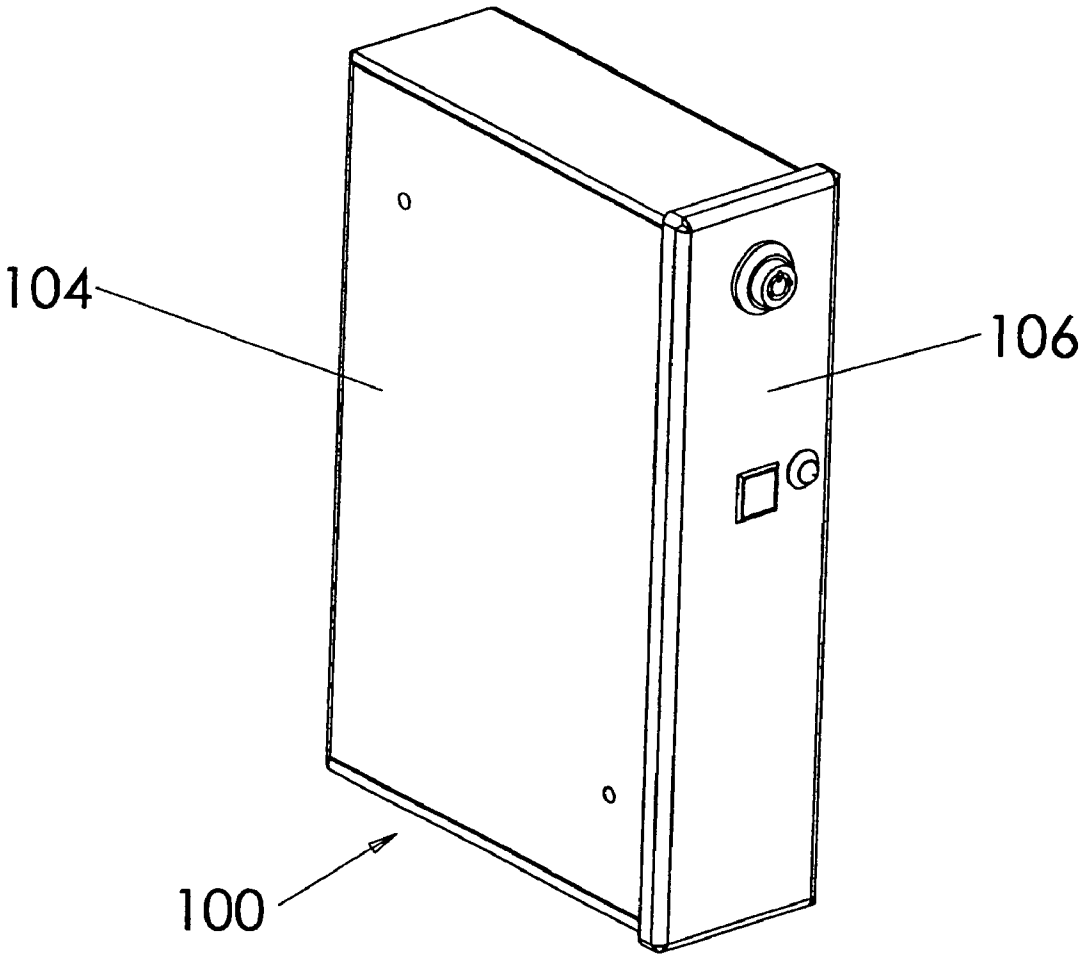
FIG. 1 is an illustration of an exemplary security enclosure.

For the purposes of promoting an understanding of the principles of the invention, reference will now be made to embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

This disclosure is directed to a security enclosure for a handgun. The security enclosure may be used to secure the handgun against unauthorized access while permitting quick and easy authorized access. While the security enclosure may be any size and may fit multiple handguns or other items, as discussed herein, the security enclosure may be sized to securely contain a single handgun. Because of its size, it may be stored in locations not conducive to placement of conventional gun safes. For example, it may be sized in a manner that permits a user to affix the security enclosure in a vehicle, such as to the front, side, or below a car seat. In addition, the security enclosure may be configured in a manner allowing it to be securely affixed within the vehicle so that it cannot easily be removed by unauthorized persons. This permits a gun user to store his or her handgun within the security enclosure without concern that the gun or the entire security enclosure with the gun inside may be stolen from the vehicle.

Although used as a precaution against unauthorized access, the security enclosure also may be configured in a manner that permits quick and easy access to an authorized person. For example, the security enclosure may be configured in a manner to easily unlock and quickly open, permitting a user to grasp the grip of a handgun stored inside. In some embodiments, as the security enclosure opens, the handgun is displaced from inside the security enclosure to a position at least partially outside the security enclosure so that the handgun can be simply grasped and pulled from the enclosure. Furthermore, in some embodiments, the displacement of the handgun from the security enclosure may position the handgun grip at the FBI cant. Accordingly, even in an emergency situation, the handgun may be quickly and easily accessed for use.

Figure 2:
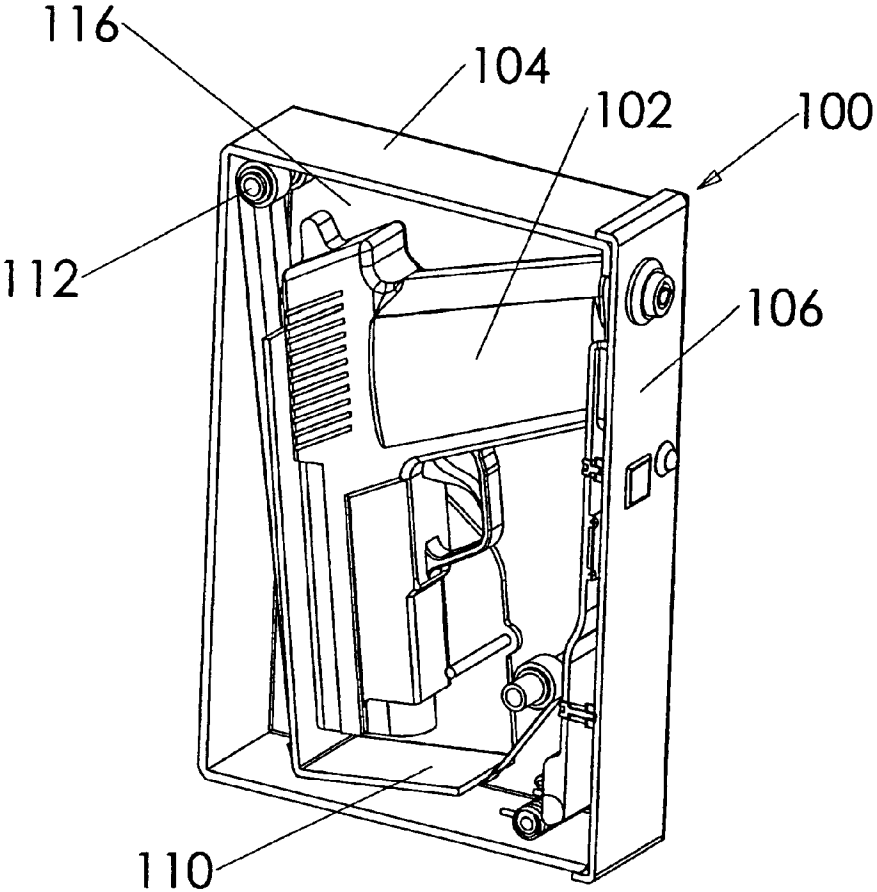
FIG. 2 is an illustration of a cross-section of the exemplary security enclosure of FIG. 1.
Figure 3:
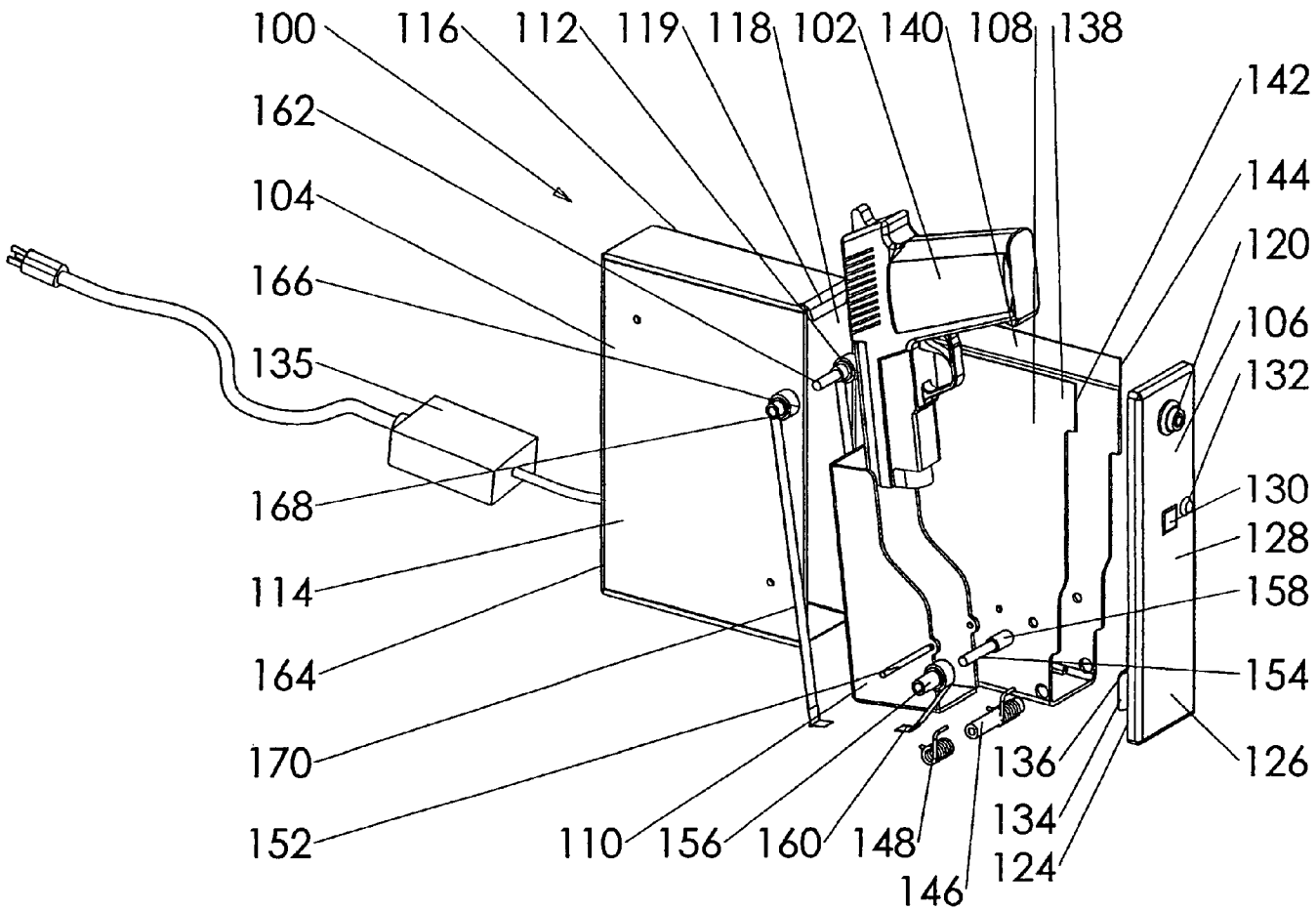
FIG. 3 is an exploded view illustration of the components of the security enclosure of FIG. 1.

The security enclosure is described below with reference to FIGS. 1-3. These Figures show an exemplary embodiment of a security enclosure 100. FIG. 1 shows the security enclosure 100 as it would appear to a user, such as a consumer, and FIG. 2 shows the security enclosure 100 in cross-section, disclosing its different interior components. FIG. 3 is an exploded view of the security enclosure 100.

In the exemplary embodiment shown, the security enclosure 100 includes a closure base 104, a cover 106, a main insert 108, a gun enclosure 110, and a rotation mechanism 112. In the exemplary embodiment shown, the closure base 104 is box body having a rectangular shape with large, parallel faces 114 and 116. In other embodiments, the closure base 104 may have an alternate shape including, for example, features for aesthetics or features that permit the security enclosure 100 to better attach to features of components in a vehicle or other desired attachment location.

In the exemplary embodiment shown, the closure base 104 is sized and shaped in a manner to have an overall width only slightly greater than that of a firearm contained within. Accordingly in some examples, it has a width less than five inches while in other embodiments, in has a width less than three inches.

FIG. 3 shows additional detail of the closure base 104. As can be seen, the closure base includes an open end 118 defined by long and short edges. In the exemplary embodiment shown, the closure base 104 includes a locking lip 119 extending inwardly from one of the short edges. The cover 106 may pivot about a location adjacent the opposing short edge. This locking lip 119 interfaces with the cover 106 to secure it in place. While shown as extending from a short edge, it is contemplated that the locking lip 119 may extend from one of the long edges and the cover may pivot about a location adjacent the opposing long edge. In some exemplary embodiments, the closure base 104 may be constructed of 10 gauge stainless steel. In other embodiments, the closure base 104 may be constructed of 10 gauge CRS and powder painted, or be constructed of aluminum or of plastic.

Referring to FIG. 3, in the exemplary embodiment shown, the cover 106 includes a drum lock 120, a biometric fingerprint reader 128, and an indicator light 132.

The drum lock 120 may be disposed toward one end of the cover 106 to lock the cover to the closure base 104. In some embodiments, the drum lock 120 moves between a locked and a unlocked position. When used with the fingerprint reader 128, the security enclosure 100 can be opened only when both the drum lock 120 is in an unlocked position and the biometric fingerprint reader is activated by an authorized print. When the drum lock 120 is in the locked position, the security enclosure 100 cannot be opened regardless of the fingerprint reader 128. In an alternative embodiment, the drum lock 120 itself can be rotated between the locked and unlocked positions by either the key or by the fingerprint reader 128.

In some embodiments, the drum lock 120 may be a three-position drum lock 120 having a first position locking the cover 106 to the closure base 104 so that it cannot be opened without a key thereby overriding and/or electrically disconnecting the biometric fingerprint reader 128, a second position unlocking the cover 106 from the closure base so that the security enclosure 100 can be opened, and a third position that enables the biometric fingerprint reader 128 to unlock the cover 106 from the closure base 104 so that the security enclosure 100 can be opened.

In some embodiments, the cover 106 may employ a locking shaft (not shown) that engages the locking lip 119 of the closure base 104 to lock the cover 106 to the closure base 104. The drum lock 120 may be configured to engage and disengage the locking shaft with the locking lip 119. In addition, the drum lock 120 may be configured to selectively permit the fingerprint reader 128 to control the locking shaft to engage and disengage the locking shaft with the locking lip 119. In some embodiments, the locking shaft may be biased toward a locking position so that while the cover 106 is being closed, the locking lip 119 axially displaces the locking shaft until it is below the locking lip. Once it is below the locking lip 119, the biased locking shaft axially moves into the locked position.

Figure 4:
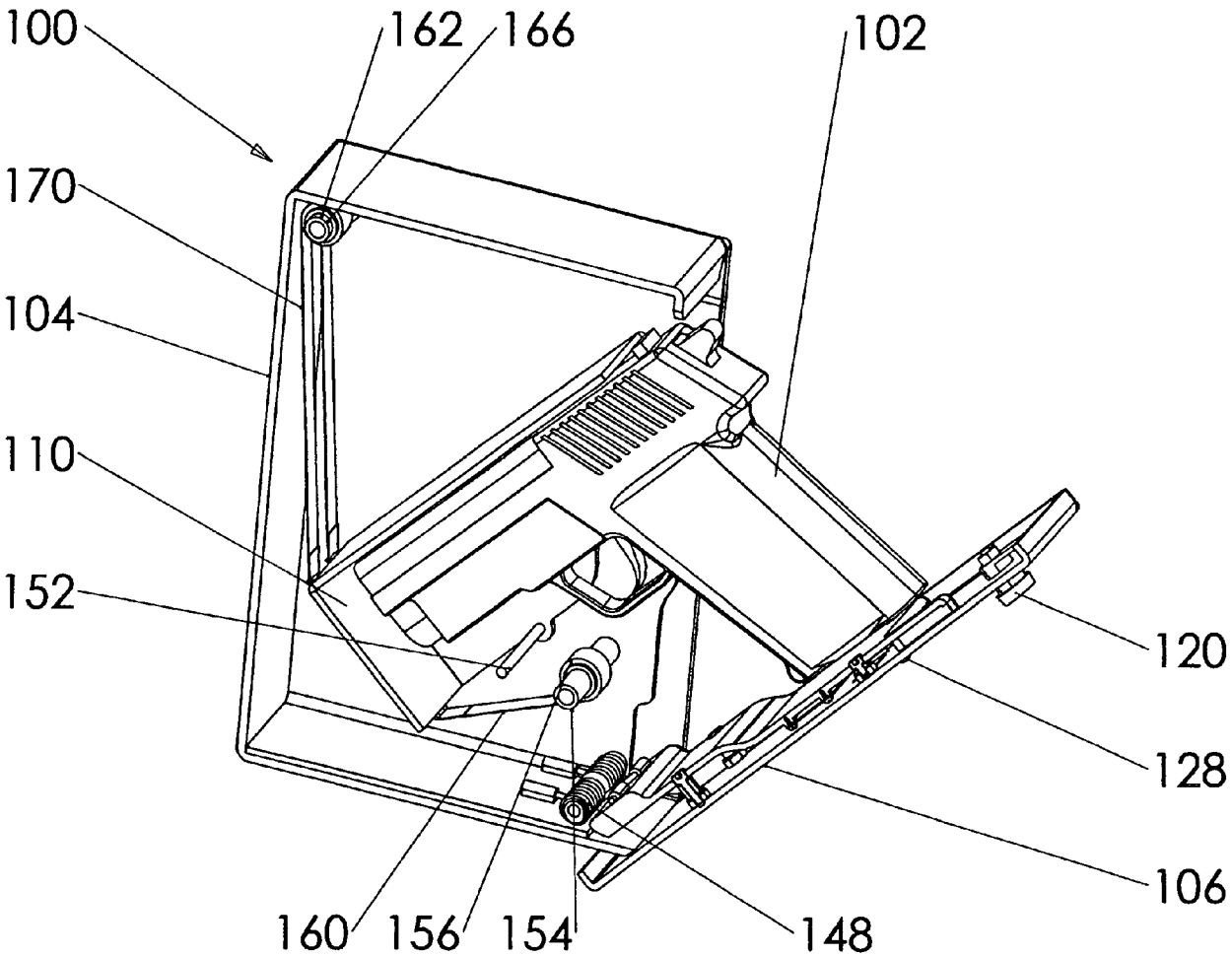
FIG. 4 is an illustration of the security enclosure of FIG. 1 in a partially open configuration.

The cover 106 may be rectangular in shape and may be rotatably connected to cover the open end 118 in the closure base 104 at an end opposite the locking pin 119. In an exemplary embodiment, a cam action hinge may be employed that allows the rear end of the cover to move inboard toward the latch side and swing toward the rear as the cover lifts open. In an exemplary embodiment, the cover 106 opens approximately 90 degrees so that the bottom edge of the cover is perpendicular with the bottom of the closure base 104. The cam action hinge, or other hinge, may be biased to an open position by torsion springs. In some embodiments, the cover 106 may have an interior wall 124 and an exterior wall 126. In some embodiments, the exterior wall may be constructed of 10 gauge stainless steel and the interior wall may be of lighter construction. As shown in FIG. 4, in some embodiments, the hinge may be configured in a manner that a side of the closure base 104 may extend inwardly between the interior wall 124 and the exterior wall 126. This may be controlled by the type and location of the hinge or other attachment mechanism.

In some exemplary embodiments, the cover 106 may include the biometric fingerprint reader 128 mounted between the interior wall 124 and the exterior wall 126 and located at a window 130 on the exterior wall 126. The window 130 permits the reader portion of the fingerprint reader 128 to be disposed on the exterior surface of the cover 106. The biometric fingerprint reader 128 may operate by conventional means known in the art, such as by activating a solenoid (not shown) upon detecting an authorized fingerprint. In some examples, the solenoid may be disposed to displace a locking shaft that engages or disengages with the locking lip 119 of the closure base 104. Alternatively, it may engage the drum lock 120 as discussed above.

The indicator light 132 is also on the outside of the cover 106 to signal different modes of operation, including whether the security enclosure 100 is operating with an A/C power adaptor, under battery power, or whether the battery level is diminished and needs replacing. In other embodiments, the indicator light 132 indicates, for example, that the drum lock 120 and fingerprint reader 128 are configured in a manner to permit access to the handgun only using the fingerprint reader 128 or alternatively, that the drum lock 120 and fingerprint reader 128 are configured in a locked manner so that access to the handgun can be granted only after using the key to turn the drum lock and to use the fingerprint reader 128. In other embodiments, the indicator light 132 may be configured to convey information regarding a number of different conditions. For example, the indicator light may be continuously on when the security enclosure 100 may be opened using only the fingerprint reader, slowly blinking when the security enclosure 100 is locked independent of the fingerprint reader, quickly blinking when the power supply is low, and off only when there is no power. Naturally, other alternatives also are contemplated. Although described using a drum lock, in some embodiments, the drum lock is not present or may be some other type of lock.

The cover 106 may house power wiring 134 to receive power from an external A/C power adaptor 135 to provide power to the biometric thumb print reader 128 and its associated solenoid. This may connect to the cover 106 through an auxiliary power jack disposed in the cover 106 or elsewhere in the security enclosure 100. Some embodiments of the cover 106 may also house a battery 136 to provide power. This may be useful, for example, when the security enclosure 100 is used in a vehicle without connecting to an electrical power source, or the A/C power is unavailable. Some embodiments employ a rechargeable battery that is recharged using the A/C power source. The battery 136 and power wiring 134 may be located between the interior wall 124 and the exterior wall 126 of the cover 106.

As shown in the exemplary security enclosure 100 in FIGS. 2 and 3, the main insert 108 fits inside of the closure base 104. The main insert 108 may be U shaped and open at the top and sides with relatively flat, parallel main insert faces 138 and 140. The parallel main insert faces 138 and 140 of the main insert 108 may be sized to be nearly as large as the parallel faces 114 and 116 of the closure base 104. Edges 142 and 144 of the parallel main insert faces 138 and 140 may be configured to follow the dimensions of the cover 106 to allow the cover 106 to fully close the closure base 104 without interference with the cover.

In some exemplary embodiments, the parallel main insert faces 138 and 140 are configured in a manner that they are offset from the inner surfaces of the parallel faces 114 and 116 of the closure base 104, forming a thin gap. This gap may provide an insulative effect to the security enclosure. Accordingly, the interior of the security enclosure 100 may be at least partially insulated from the high and low temperatures that may be found for example in vehicle interiors.

The main insert 108 includes holes that receive a torsion spring axis 146 and one or more torsion springs 148. Here, the torsion spring axis 146 is located near the corner of the main insert 108 that is near the open end 118 but opposite the locking lip 119. The torsion spring axis 146 is perpendicular to the parallel main insert faces 138 and 140 and is installed between the parallel main insert faces 138, 140. The torsion spring axis 146 and the one or more torsion springs 148 cooperate to provide a rotating force to open the cover 106 when unlocked. Accordingly, the cover 106 is biased toward the open position.

When closed, the cover 106 contacts the handgun 102, holding it within the security enclosure 100. Because in use the bottom of the handgun grip may be in contact with and biased against the cover 106, the cover 106 also may include a cushioning or dampening material. This material may protect the bottom of the handgun grip and may muffle unwanted noise that may occur if the handgun and/or gun enclosure 110 vibrates against the cover 106, as may occur when the security enclosure 100 is used in a vehicle.

In the exemplary embodiment shown, the gun enclosure 110 may be housed within the main insert 108. This gun enclosure 110 acts as a holster within the security enclosure 100 and may be made from traditional holster materials such as leather, from polymer materials including neoprene or polyethylene, or from any other suitable material. In some examples, the gun enclosure 110 may be form molded about the gun, may be injection molded, or otherwise formed. In some examples, the gun enclosure 110 may be molded of Kydex®. In other examples, the gun enclosure 110 may be designed to fit the individual dimensions of specific handguns available from a wide variety of handgun manufacturers, such as, for example, Glock®, Smith and Wesson®, among others. Accordingly, it may be made to fit a specific make and/or model of handgun. In some exemplary embodiments, the gun enclosure may manufactured by molding it about the gun to provide a custom-fit.

The gun enclosure 110 may be designed to hold the barrel of the gun and allow a user to easily grasp the grip of the handgun when the gun enclosure 110 is rotated out of the security enclosure 100, as described in more detail below. The gun enclosure 110 is rotatably mounted between the parallel main insert faces 138 and 140 on a pivot arm 152. In the example shown, the pivot arm 152 is a shaft extending through receiving holes in the gun enclosure 110 and the main insert 108, thereby connecting the gun enclosure 110 to the main insert 108. As shown in the Figures, the pivot arm 152 is disposed to define an axis transverse to the gun enclosure 110 and the handgun 102.

In the exemplary embodiment shown, the rotation mechanism 112 operates to displace the gun enclosure 110 from a position within the closure base 104 to a position where the associated handgun 102 projects out of the closure base 104 for easy grasping by a user. The rotation mechanism 112 includes a front load spring arm 154 and a rear load spring arm 162 that each apply a force against the gun enclosure 110 to rotate it about the pivot arm 152.

In the embodiment shown, the front load spring arm 154 mounts between the main insert faces 138 and 140 and is positioned between the gun enclosure 110 and cover 106. The front load spring arm 154 may include a front counter balance load spring 156 and a nylon spacer 158. The front counter balance load spring 156 may include a band 160 connected to the gun enclosure 110 to provide a torque tending to rotate the barrel end of the gun enclosure 110 towards the front counter balance load spring 156. In some exemplary embodiments, the front counter balance load spring 156 may be a flat steel constant force spring. This constant force spring is configured to provide a substantially consistent biasing force regardless of the amount of spring extension.

Still referring to FIG. 3, in this exemplary embodiment, the rear load spring arm 162 mounts between the main insert faces 138 and 140 and is positioned between the gun enclosure 110 and a rear 164 of security enclosure 100. The rear load spring arm 162 includes one or more rear load springs 166 and a nylon spacer 168. In an exemplary embodiment, the one or more rear load springs 166 may be one or more flat steel constant force springs. The one or more rear load springs 166 include one or more bands 170 that are connected to the gun enclosure 110 to provide a torque tending to rotate the barrel of the gun towards the one or more rear load springs 166. As further set forth below, rear load springs 166 provide a greater biasing force than the front counter balance load spring 156. This biases the gun enclosure 110 toward an accessible position, holding a gun partially out of the closure base 104. The handgun 102 or the gun enclosure 110 may be moved back into the non-accessible position by closing the cover 106. The cover 106 contacts the handgun 102 or the gun enclosure 110 to move it into the closure base 104, overcoming the greater biasing force of the rear load springs 166.

In the exemplary embodiment shown in FIG. 4, the rear load springs 166 comprise two flat steel constant force springs and the front counter balance load spring 156 comprises one flat steel constant force spring. In some embodiments, the springs are selected to have the same constant force. For example, in such an embodiment, the two rear load springs together may provide a force substantially double that of the single front counter balance load spring. In other embodiments, the constant force springs may be selected with different constant forces.

When a user desires to access a gun in the security enclosure 100, as illustrated in FIG. 4, the cover 106 may be unlocked by a user placing his or her finger on the biometric fingerprint reader 128, which scans the fingerprint and compares it to authorized fingerprints stored in the memory of the biometric fingerprint reader. If the fingerprint of the user matches a stored authorized fingerprint, a signal is sent to operate the solenoid (not shown) to unlock the drum lock 120 or otherwise unlock the cover 106. The drum lock 120 may be unlocked with its key in the case of an electrical power failure or operative failure by the biometric fingerprint reader 128.

Once the cover 106 is unlocked, the one or more torsion springs 148 rotate the cover 106 away from the closure base 104. Upon opening of the cover 106, the one or more rear load springs 166 rotate the gun enclosure 110 about pivot arm 152. The gun enclosure 110 is rotated by the exertion of a torsional force by the one or more rear load springs 166 that retracts the one or more bands 170 and thereby rotates the gun enclosure 110 about pivot arm 152. The torsional force exerted by the one or more rear load springs 166 is designed to exceed the torsional force exerted by the front counter balance load spring 156, which results in the extension of the band 160 from the front counter balance load spring 156. The opposing torsional force exerted by the front counter balance load spring 156 against the torsion exerted by the one or more rear load springs 166 allows for smoother, non-jarring rotation of the gun enclosure 110. In one embodiment, either the front load spring arm 154 or the rear load spring arm 162, or both, may include frictional washers (not shown) to provide for smoother rotation and elevation of the gun enclosure 110.

As shown in FIG. 4, when the security enclosure 100 is open, the handgun 102 may be held at or around the FBI cant of about 15 degrees relative to the security enclosure. This permits the user to easily and securely grasp the handgun 102. It is noted that it is contemplated that in some embodiments, the cant or angle may be within the range of 10-40 degrees relative to the security enclosure 110. Other cants or angles are contemplated. Further, as indicated by a comparison of FIGS. 2 and 4, the gun enclosure 110 rotates about the pivot arm 152 through a range of, for example, between 20 and 120 degrees. Alternative embodiments may allow the gun enclosure to rotate within a range of about 60 to 120 degrees. In some embodiments, the gun enclosure 110 is configured to rotate in within a range of about 80-100 degrees. However, rotation amounts both greater and smaller than these ranges are contemplated.

As is apparent from FIG. 4, by placement of the pivot arm 152 a distance above the hinge pin 122, the rotation of the gun enclosure 110 about the pivot arm 152 provides a greater separation of the gun from the cover 106, providing more room to access to the handgun. Additionally, the placement of the pivot arm 152 close to the open end 118 allows the handgun to project well out of the closure base 104, after rotation of the gun enclosure 110, ensuring accessibility to the grip of the hand gun.

Figure 5:
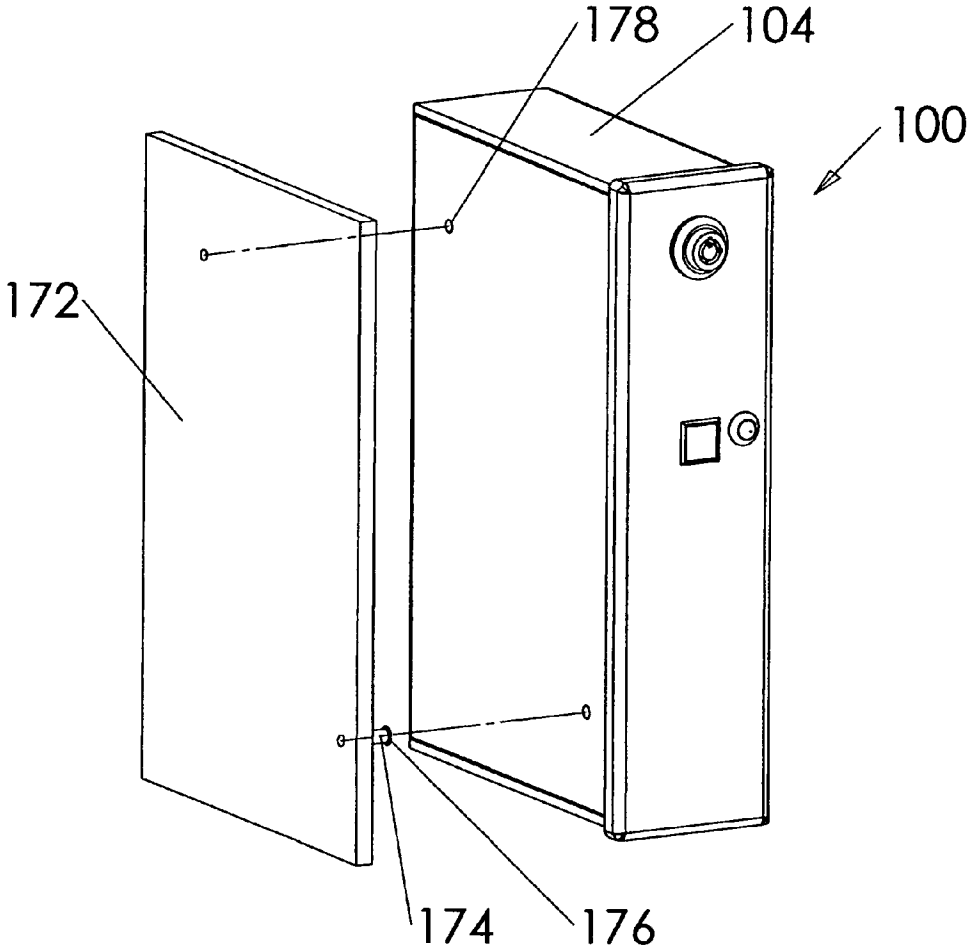
FIG. 5 is an illustration of a mounting plate for the security enclosure of FIG. 1.

In some embodiments, the security enclosure 100 described herein is only somewhat larger than the handgun that it contains and is therefore portable and capable of being carried between a user's home and a second residence, vehicle, or other location. Referring to FIG. 5, the security enclosure 100 may be removably connected to one or more mounting plates 172. In order to secure the security enclosure 100 in a desired location, the closure base 104 may, in some embodiments, include holes 178 formed therein that are key slotted to receive mounting pins 174, such as, for example, bolts or other fasteners, that removably secure the closure base 104 in a desired location. In some embodiments, the mounting pins 174 may include a quick latch 176 or other securing fastener that may only be released from the interior of the closure base 104. In an exemplary embodiment, the quick latch 176 may be an expandable head that may collapse to fit through the holes 178 of the closure base 104 and then expand when the mounting pins 174 are inserted into the holes, thus preventing the closure base from being removed from the mounting plate 172. To remove the closure base 104 from the mounting plate 172, the quick latch 176 may be released from the interior of the closure base 104. Thus, only a person authorized to have access to the handgun can also remove the closure base 104 from its location. In an exemplary embodiment, the mounting plate 172 could be mounted to either the right side or the left side of the closure base 104. Alternatively, it is contemplated that a mounting plate could be mounted to either the top or bottom, or back side of the closure base 104. It is contemplated that the closure base 104 also may be more permanently secured in a desired location, such as by welding or other methods.

The one or more mounting plates may be connected to a location in a residence or vehicle, for example, a nightstand, in a closet, or in a vehicle, such as on a car seat. In some exemplary embodiments, a user may use the closure base 104 with multiple mounting plates securely attached in desired locations. This would permit the user to, for example, detach the security enclosure 100 from a mounting plate in a bedroom and attach the security enclosure 100 to a mounting plate in a vehicle.

In some exemplary embodiments, the gun enclosure 110 may be removed from the security enclosure 100 and replaced with a second gun enclosure. This may permit a user to use the security enclosure with a second gun sized differently than the first. In some embodiments, the entire main insert 108, with the attached gun enclosure 110 and rotation mechanism 112 may be removed from the closure base 102 and replaced with a second main insert with a second gun enclosure and second rotation mechanism that may be more suited to operate with a second handgun.

In view of the above and the figures, it should be apparent to those skilled in the art that the present disclosure introduces a security enclosure, including an enclosure base; a cover rotatably connected to the enclosure base; wherein the cover may be rotated from a first position in which the cover is locked to the enclosure base to a second position in which the cover allows access to the interior of the enclosure base. The security enclosure also including a gun enclosure rotatably connected to the enclosure base by one or more torsional springs; wherein the gun enclosure comprises a Kydex molded holster; and wherein the Kydex holster is custom molded for a particular handgun and is replaceable with another Kydex molded holster; and a biometric recognition device to initiate unlocking of the cover when exposed to a required feature of an authorized user; wherein the biometric recognition device is a fingerprint recognition device. The security enclosure also including a mounting plate removably coupled to the enclosure base; an alarm; an interior light source; and a lock configured to override the biometric recognition device and unlock the cover.

In view of the above and the figures, it should be apparent to those skilled in the art that the present disclosure introduces a security enclosure, including an enclosure base; a cover rotatably connected to the enclosure base; wherein the cover may be rotated from a first position in which the cover is locked to the enclosure base to a second position in which the cover allows access to the interior of the enclosure base; and a gun enclosure rotatably connected to the enclosure base; wherein the gun enclosure rotates a handgun from a near vertical position with the barrel pointing down to a diagonal position with the barrel still pointing down. The security enclosure also including a biometric recognition device to initiate unlocking of the cover when exposed to required feature of an authorized user; wherein the biometric recognition device is a fingerprint recognition device; a mounting plate removably coupled to the enclosure base; an alarm; an interior light source; wherein the gun enclosure further comprises a Kydex molded holster; wherein the Kydex molded holster is custom molded for a particular model handgun and is replaceable with another Kydex molded holster; wherein the gun enclosure is rotatably connected to the enclosure base by one or more torsional springs; and a key-lock to override the biometric recognition device and unlock the cover.

In view of the above and the figures, it should be apparent to those skilled in the art that the present disclosure introduces a security enclosure, including an enclosure base; a cover rotatably connected to the enclosure base; wherein the cover may be rotated from a first position in which the cover is locked to the enclosure base to a second position in which the cover allows access to the interior of the enclosure base; a biometric recognition device to initiate unlocking of the cover when exposed to required feature of an authorized user; a gun enclosure that rotates and elevates relative to the cover upon unlocking of the cover; wherein the biometric recognition device is a fingerprint recognition device; a mounting plate removably coupled to the enclosure base; an alarm; an interior light source; wherein the gun enclosure further comprises a Kydex molded holster; wherein the Kydex molded holster is custom molded for a particular model handgun and is replaceable with another Kydex molded holster; wherein the gun enclosure rotates and elevates relative to the cover upon unlocking of the cover by one or more torsional springs; and a key-lock to override the biometric recognition device and unlock the cover.

In view of the above and the figures, it should be apparent to those skilled in the art that the present disclosure introduces a security enclosure, including an enclosure base; a cover rotatably connected to the enclosure base; wherein the cover may be rotated from a first position in which the cover is locked to the enclosure base to a second position in which the cover allows access to the interior of the enclosure base; a biometric recognition device to initiate unlocking of the cover when exposed to required feature of an authorized user; wherein the biometric recognition device is one of a fingerprint recognition device and a voice recognition device; a gun enclosure that rotates and elevates relative to the cover upon unlocking of the cover; wherein the gun enclosure rotates and elevates relative to the cover upon unlocking of the cover by one or more springs; wherein the gun enclosure further comprises a Kydex molded holster custom molded for a particular model handgun and is replaceable with another Kydex molded holster; and a mounting plate removably coupled to the enclosure base.

Although illustrative embodiments of the invention have been shown and described, a wide range of modification, changes and substitution is contemplated in the foregoing disclosure. For example, the security enclosure may include an interior light and/or an alarm that is activated, for instance, if the security enclosure is subject to prying, or there are an excessive amount of failed attempts at obtaining entry to the security enclosure. Alternatively, or in addition to, the security enclosure may utilize a lock that can be accessed through the use of a keypad or a combination. Furthermore, in lieu of, or in addition to, the security enclosure may include a biometric authorization system that is based on voice recognition, or other biometric indicator. Also, the locking system may be connected to the body of the security enclosure instead of the cover of the security enclosure. The security enclosure does not have to be rectangular, but could be octagonal, or circular, or of another other shape. In some instances, some features of the present invention may be employed without a corresponding use of the other features, and some steps of the present invention may be executed without a corresponding execution of other steps. Accordingly, all such modifications, changes and substitutions are intended to be included within the scope of this invention as defined in the following claims, and it is appropriate that the claims be construed broadly and in a manner consistent with the scope of the invention. In the claims, means-plus-function clauses are intended to cover the structures described herein as performing the recited function and not only structural equivalents, but also equivalent structures.

What is claimed is:

1. A security enclosure, comprising:

an enclosure base having inner wall surfaces and an opening to an interior portion defined between the inner wall surfaces;

a cover configured to selectively cover the opening in the enclosure base, the cover being configured in a manner to rotate from a first position in which the cover blocks access to the interior portion of the enclosure base to a second position in which the cover allows access to the interior portion of the enclosure base;

a positioning structure having first and second parallel side walls rigidly connected by a third side wall, the first and second side walls spaced apart from inner wall surfaces of the enclosure base when the positioning structure is within the enclosure base;

a gun positioner housed within the positioning structure and rotatably disposed within the enclosure base to rotatably displace a handgun in a plane defined by the handgun from a first position entirely within the enclosure base to a second position where at least a part of the handgun protrudes out of the opening for grasping by a user, the gun positioner being configured to rotate about a pivot axis substantially transverse to the handgun plane to displace the handgun within the handgun plane; and a biasing element operating against the cover in a manner that biases the cover to the second position, the biasing element being disposed at least partially between the first and second side walls of the positioning structure.

2. The security enclosure of claim 1 comprising one or more springs configured to rotate the gun positioner relative to the enclosure base.

3. The security enclosure of claim 1 further comprising a mounting plate removably coupled to the enclosure base.

4. The security enclosure of claim 1 wherein the gun positioner comprises a molded holster.

5. The security enclosure of claim 4 wherein the molded holster is formed of Kydex and is custom molded for a particular handgun, and wherein the gun positioner is replaceable within the enclosure base.

6. The security enclosure of claim 1 comprising a biometric recognition device configured to operatively unlock the cover when exposed to a required feature of an authorized user.

7. The security enclosure of claim 6 further comprising means to override the biometric recognition device and unlock the cover.

8. The security enclosure of claim 7 wherein the means to override the biometric recognition device and unlock the cover is one of a key, a keypad, and a combination entry.

9. The security enclosure of claim 1, wherein the gun positioner is housed entirely within the positioning structure.

10. The security enclosure of claim 1, wherein the positioning structure is immovably disposed within the enclosure base.

11. The security enclosure of claim 1, wherein the side walls of the positioning structure are parallel.

12. A security enclosure, comprising:

an enclosure base having inner wall surfaces and an opening to an interior portion defined between the inner wall surfaces;

a cover configured to selectively cover the opening in the enclosure base, the cover being configured in a manner to rotate from a first position in which the cover blocks access to the interior portion of the enclosure base to a second position in which the cover allows access to the interior portion of the enclosure base;

a positioning structure disposable in the opening of the enclosure base, the positioning structure having first and second parallel side walls rigidly connected by a third side wall, the first and second side walls spaced apart from inner wall surfaces of the enclosure base when the positioning structure is within the enclosure base;

a gun positioner housed within the positioning structure and rotatably disposed within the enclosure base, the gun positioner being arranged to secure a handgun such that an end face of a grip of the handgun faces the cover when the cover is in the first position in which the cover blocks access to the interior portion of the enclosure base; and a biasing element operating against the cover in a manner that biases the cover to the second position.

13. The security enclosure of claim 12 further comprising a rotation mechanism configured to rotate the gun positioner, the rotation mechanism configured to rotate the gun within a range of about 20 to 120 degrees.

14. The security enclosure of claim 12 further comprising one or more springs configured to rotate the gun positioner relative to the enclosure base.

15. The security enclosure of claim 12 further comprising a biometric recognition device to operatively unlock the cover from the enclosure base when exposed to a required feature of an authorized user.

16. The security enclosure of claim 15 wherein the biometric recognition device is one of a fingerprint recognition device and a voice recognition device.

17. The security enclosure of claim 15 further comprising means to override the biometric recognition device and unlock the cover.

18. The security enclosure of claim 17 wherein the means to override the biometric recognition device and unlock the cover is one of a key, a keypad, and a combination entry.

19. The security enclosure of claim 12 further comprising a mounting plate removably coupled to the enclosure base.

20. The security enclosure of claim 19 wherein the molded holster is custom molded of Kydex material for a particular model handgun.

21. The security enclosure of claim 12 further comprising an alarm.

22. The security enclosure of claim 12 wherein the gun positioner further comprises a molded holster.

23. A security enclosure, comprising:

an enclosure base having inner wall surfaces and an opening to an interior portion defined between the inner wall surfaces;

a cover configured to selectively cover the opening in the enclosure base, the cover being configured in a manner to rotate from a first position in which the cover blocks access to the interior portion of the enclosure base to a second position in which the cover allows access to the interior portion of the enclosure base;

a positioning structure disposable in the opening of the enclosure base, the positioning structure having first and second parallel side walls rigidly connected by a third side wall, the first and second side walls spaced apart from inner wall surfaces of the enclosure base;

a gun positioner disposed within the positioning structure and configured to position a handgun, the gun positioner being configured to rotate about a pivot point within the enclosure base to rotatably displace a handgun in a plane defined by the handgun from a first position entirely within the enclosure base to a second position where at least a part of the handgun protrudes out of the opening for grasping by a user; and a biasing element operating against the cover in a manner that biases the cover to the second position.

24. The security enclosure of claim 23 further comprising a mounting plate removably coupled to the enclosure base.

25. The security enclosure of claim 23 comprising one or more springs configured to rotate the gun positioner relative to the enclosure base.

26. The security enclosure of claim 23 wherein the gun positioner further comprises a Kydex molded holster.

27. A security enclosure for a handgun, comprising:

an enclosure base having inner wall surfaces and an opening to an interior portion defined between the inner wall surfaces;

a cover configured to selectively cover the opening in the enclosure base, the cover being configured in a manner to rotate from a first position in which the cover blocks access to the interior portion of the enclosure base to a second position in which the cover allows access to the interior portion of the enclosure base;

a positioning structure in the enclosure base, the positioning structure having first and second parallel side walls rigidly connected by a third side wall, the first and second side walls spaced apart from inner wall surfaces of the enclosure base;

a biometric fingerprint recognition device configured to operatively unlock the cover from the enclosure base when exposed to a required feature of an authorized user;

a gun enclosure housed within the positioning structure and shaped to receive and hold a handgun that defines a longitudinal handgun plane, the gun enclosure being configured to rotate about a pivot axis substantially normal to the handgun plane through the enclosure base to rotatably displace a handgun from a position within the enclosure base to a position where at least a part of the handgun protrudes out of the opening;

a biasing element disposed at least partially between the first and second side walls of the positioning structure within the enclosure base and being configured to exert a force that results in rotation of the gun enclosure about the pivot axis to move the gun enclosure substantially in the longitudinal handgun plane transverse to the pivot axis, the biasing element operating against the cover in a manner that biases the cover to the second position.

* * * * *